US007779919B2

(12) United States Patent
Goughnour et al.

(10) Patent No.: US 7,779,919 B2
(45) Date of Patent: Aug. 24, 2010

(54) FLAPPER VALVE RETENTION METHOD AND SYSTEM

(75) Inventors: Paul G. Goughnour, Fresno, TX (US); David James Biddick, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 72 days.

(21) Appl. No.: 12/108,295

(22) Filed: Apr. 23, 2008

(65) Prior Publication Data

US 2009/0266557 A1 Oct. 29, 2009

(51) Int. Cl.
*E21B 34/06* (2006.01)
*E21B 34/00* (2006.01)
*E21B 33/00* (2006.01)

(52) U.S. Cl. ..... 166/373; 166/323; 166/332.8

(58) Field of Classification Search ..... 166/321, 166/322, 373, 374, 323, 332.8
See application file for complete search history.

(56) References Cited

U.S. PATENT DOCUMENTS

| | | | | |
|---|---|---|---|---|
| 2,798,561 | A | 7/1957 | True | |
| 3,980,135 | A | 9/1976 | Garrett | |
| 4,161,219 | A | 7/1979 | Pringle | |
| 4,220,206 | A | 9/1980 | Van Winkle | |
| 4,252,197 | A * | 2/1981 | Pringle | 166/322 |
| 4,314,091 | A * | 2/1982 | Crone, Jr. et al. | 585/486 |
| 4,574,889 | A | 3/1986 | Pringle | |
| 4,605,070 | A | 8/1986 | Morris | |
| 4,722,399 | A | 2/1988 | Pringle | |
| 4,723,606 | A | 2/1988 | Vinzant | |
| 4,926,945 | A | 5/1990 | Pringle | |
| 5,165,480 | A | 11/1992 | Wagoner | |
| 5,167,284 | A | 12/1992 | Leismer | |
| 6,079,497 | A | 6/2000 | Johnston | |
| 6,230,807 | B1 | 5/2001 | Patel | |
| 6,237,693 | B1 | 5/2001 | Deaton | |
| 6,296,061 | B1 | 10/2001 | Leismer | |
| 6,433,991 | B1 | 8/2002 | Deaton | |
| 6,568,470 | B2 | 5/2003 | Goodson, Jr. et al. | |
| 6,619,388 | B2 | 9/2003 | Dietz | |
| 6,684,950 | B2 | 2/2004 | Patel | |
| 6,877,564 | B2 | 4/2005 | Layton | |
| 6,902,006 | B2 | 6/2005 | Myerley et al. | |
| 6,957,703 | B2 | 10/2005 | Trott | |
| 7,347,270 | B2 * | 3/2008 | McMillan et al. | 166/332.8 |
| 7,360,600 | B2 | 4/2008 | MacDougall et al. | |
| 2007/0137869 | A1 | 6/2007 | MacDougall | |

* cited by examiner

FOREIGN PATENT DOCUMENTS

| | | |
|---|---|---|
| GB | 2375559 | 11/2002 |

*Primary Examiner*—David J Bagnell
*Assistant Examiner*—Michael Wills, III
(74) *Attorney, Agent, or Firm*—Rodney V. Warfford; Brandon S. Clark; Trop, Pruner & Hu PC

(57) ABSTRACT

A system and method for use in a wellbore that includes a string comprising a housing. The housing comprises a valve including a valve seat having an inner channel and a flapper configured to pivot relative to the valve seat between a first position and a second position in which the inner channel is obstructed. A valve actuating device may be provided for selectively opening the valve and comprising a first hydraulic device. In addition, a retention device including a second hydraulic device may be provided and configured to selectively retain the flapper in the first position. In some cases, the first hydraulic device and the second hydraulic device may be driven by the same fluid source.

19 Claims, 4 Drawing Sheets

FLAPPER VALVE RETENTION METHOD AND SYSTEM

BACKGROUND

The present application relates generally to the field of tools for completing subterranean wells. In particular, the application relates to flapper valve retention devices.

Hydrocarbon fluids such as oil and gas are found in subterranean portions of geological formations or reservoirs. Wells are drilled into these formations for extracting the hydrocarbon fluids. Completed wells are often equipped with one or more flapper valves. The flapper valves may be safety valves or other valves used to control fluid movement. Flapper valves typically open downwards such that the pressure of the wellbore fluids bias the flapper towards a closed position.

A sleeve inside the safety valve may keep the valve open when the well is in operation. The sleeve may be maintained in position by hydraulic pressure from the surface. Should the wellhead be lost or the fluid lines from the sea bed to the platform be compromised in the case of a deep sea well, the loss of hydraulic pressure against the sleeve would result in the sleeve sliding upwardly. Accordingly, the safety valve will close to prevent further flow of wellbore fluids out of the well.

Prior to producing hydrocarbon fluids, wells must often be completed by one or more of a variety of processes. The completion processes may include, but is not limited to, perforating the well casing and/or reservoir (i.e. by use of shape charges), fracturing the formation, applying chemical treatments to the formation, or gravel packing the well, among other processes.

In many applications, a single well may pass through more than one reservoir or formation zone. In these cases, it may be desirable to complete more than one formation zone. Accordingly, a first production zone may be completed at a downhole location within a first formation. Then, a second production zone may be completed in a position above (i.e. closer to the surface) the first production zone within a second formation, or within a different area of the first formation. When carrying out the completion processes located above the first production zone, completion fluids (e.g., gravel slurries, propants, and acidifiers, among other types of completion fluids) from the second production zone may migrate downhole. Additionally, adding completion fluids in the wellbore region proximate to the second production zone may pressurize the wellbore. As a result the completion fluids from a wellbore region proximate to the second production zone may migrate to the wellbore region proximate to the first production zone. The completion fluids may ultimately migrate or flow into the surrounding first formation itself. Also, the pressurization of the wellbore may cause completion fluids remaining in the wellbore region proximate to the first production zone to migrate into the surrounding first formation.

The migration of undesired completion fluids into a production zone may damage the formation and reduce the productivity of the well. Accordingly, it may be desirable to isolate the first production zone from the second production zone during the time when the first production zone has been completed and the second production zone is undergoing completion processes. This isolation may be carried out by the use of a flapper valve or formation isolation valve for example.

In both the case of isolation and safety valves, the flapper may close in situations where it should remain open. For example, pressure deviations resulting from the completion or operation of the well may inadvertently result in the flapper partially or completely closing. Accordingly, there is a need to retain the flapper in an open position in such situations.

SUMMARY

Some embodiments relate to a system for use in a wellbore comprising a string having a housing comprising a valve. The valve may comprise a valve seat having an inner channel and a flapper configured to pivot relative to the valve seat. The flapper may be configured to move between a first position (e.g., an open position) and a second position in which the inner channel is at least partially obstructed. A valve actuating device may be provided for selectively opening the valve. The valve actuating device may comprise a first hydraulic device. Additionally, a retention device may also be provided and configured to selectively retain the flapper in the first position. The retention device may comprise a second hydraulic device. The first hydraulic device and the second hydraulic device may be actuated by the same fluid source.

Other embodiments relate to a system for conveying wellbore fluids, comprising a string having a housing comprising a valve. The valve may comprise a valve seat having an inner channel and a flapper configured to pivotal relative to the valve seat. The flapper may further be configured to move between a first position (e.g., opened) and a second position. In addition, the system may comprise a valve actuating device for selectively opening the valve. The valve acting device may comprise a first hydraulic device. A retention device may be provided in the system and configured to selectively retain the flapper in a first position. The retention device may comprise a second hydraulic device. The first hydraulic device and the second hydraulic device may be driven by the same fluid source. In some cases the second hydraulic device may have an increased release time relative to the first hydraulic device.

Yet other embodiments relate to a valve for use in a wellbore comprising a valve seat and a flapper pivotally coupled to the valve seat. The valve seat may have an inner channel. The flapper may be configured to move between a first open position and a second closed position in which the inner channel of the valve seat is obstructed. The valve may further comprise a valve actuating device for selectively opening the valve. The valve actuating device may comprise a first hydraulic device. Additionally, the valve may comprise a retention device configured to selectively retain the flapper in the first open position. The retention device may comprise a second hydraulic device having a cylinder and a piston. The first hydraulic device and the second hydraulic device may be actuated by the same fluid source. In some cases, the second hydraulic device may have an increased release time relative to the first hydraulic device. Additionally, the retention device may be configured to release the flapper in the event of a loss of hydraulic pressure.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
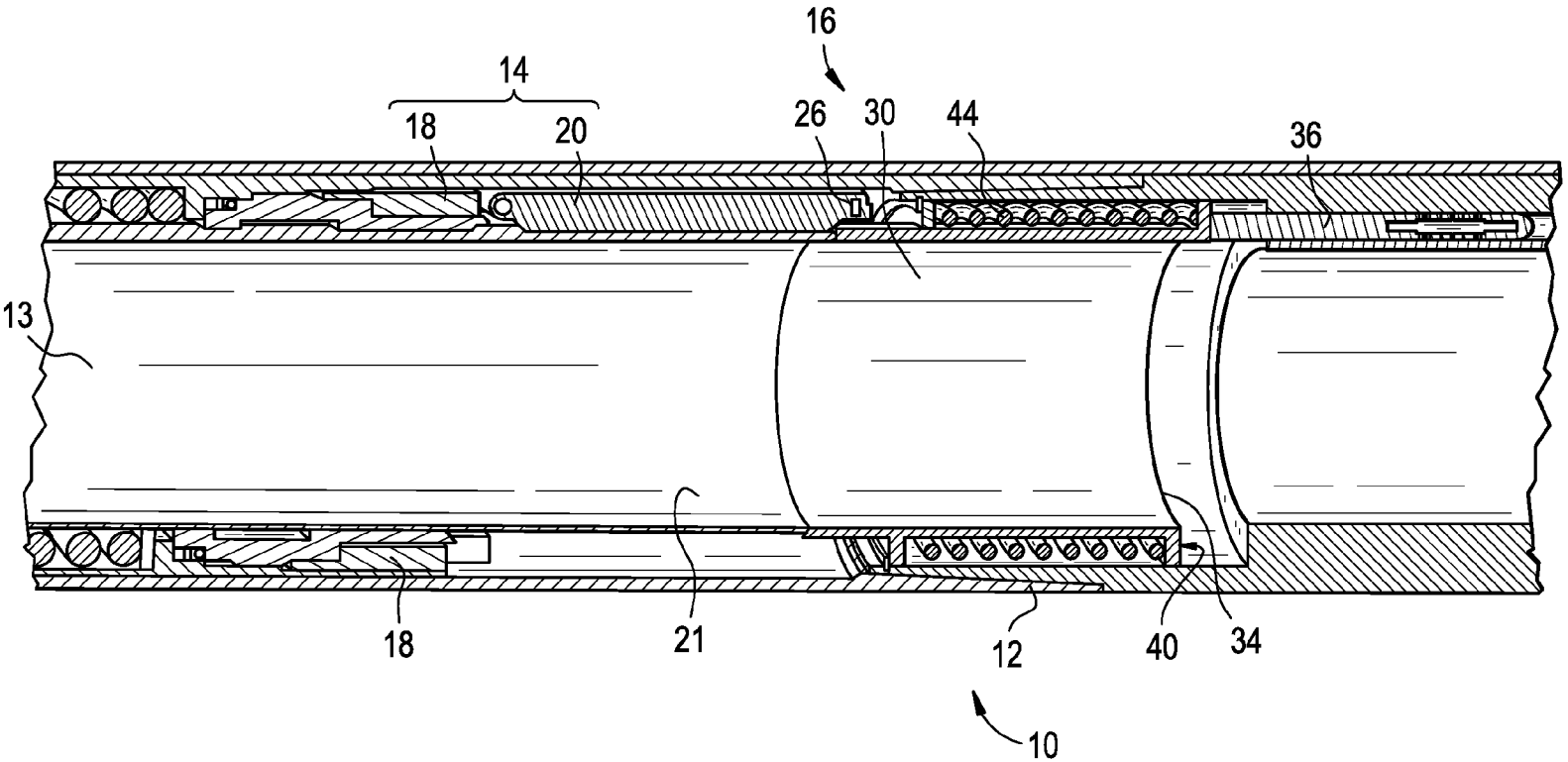
FIG. 1 is a cross-sectional view of a wellbore system incorporating aspects of the current invention.
Figure 2:
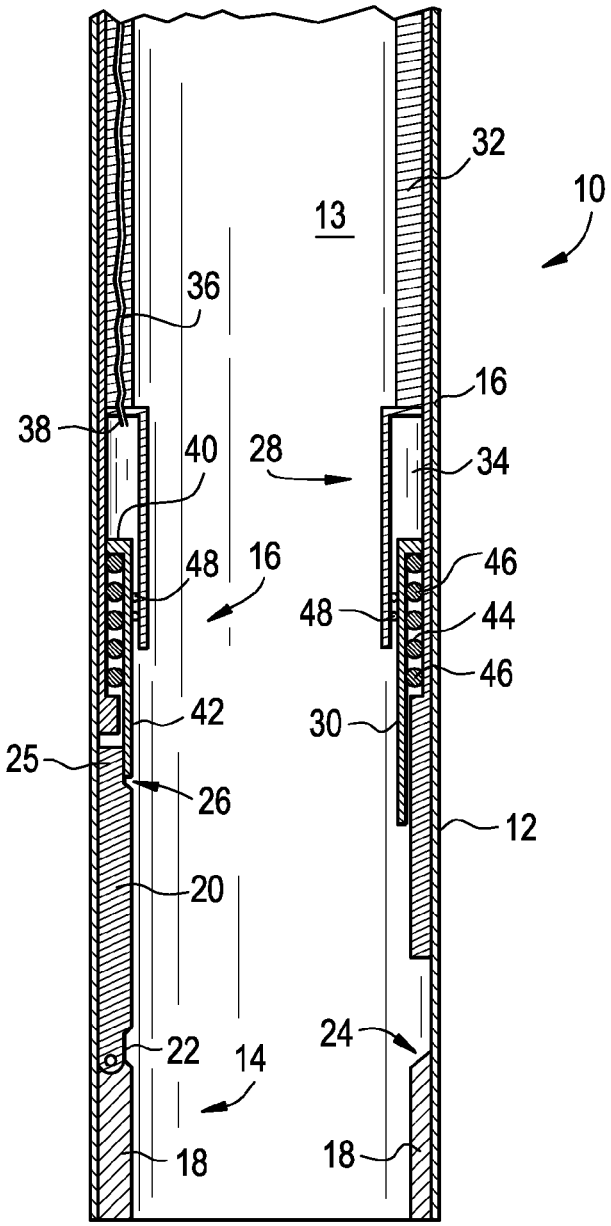
FIG. 2 is another cross-sectional view of a wellbore system in which a retention system is extended and a valve actuation system is retracted.

Referring to FIGS. 1 and 2, a flapper valve is shown retained in an open position. A system 10 for use in a downhole wellbore application may include a housing 12, a valve 14 and a retention device 16. Housing 12 at least partially encloses channel 13. Valve 14 may include a seat 18 and a flapper 20. Sleeve 21 may be positioned in valve 14 to retain flapper 20 in an open position. However, sleeve 21 may be moved or removed once the string containing valve 14 is in place within the well. In some cases, sleeve 21 may be replaceable or reinserted within channel 13 such that the sleeve 21 may be used to reopen valve 14. Alternatively, other devices may be used to open valve 14, such as hydraulic pistons, resilient members, and shifting tools, among others.

Flapper 20 may be configured to pivot relative to seat 18. In some embodiments, flapper 20 may be pivotally coupled to seat 18 by a hinge 22. Flapper 20 may generally be curved so that when the valve is in an open position, the cross-section of flapper 20 is curved and generally concentric with housing 12, resulting in a relatively unobstructed internal bore for example. Flapper seat 18 may generally be cylindrical. Seat 18 may include a surface 24 (see FIG. 2) configured to sealingly abut or contact surface 26 of flapper 20 when the valve 14 is closed, thereby preventing or restricting wellbore fluid flow through the valve 14.

Retention device 16 is shown in this illustrative example as a hydraulic device and includes a cylinder 28 and a piston 30. Alternatively a bellows system, sleeve, latch pin, or other retention method may be used. Piston 30 may define a portion of channel 13 and may be configured to allow wellbore fluids to pass through retention device 16. Cylinder 28 may be coupled to tube 32. In some cases, cylinder 28 may be integral with or internally formed within tube 32 for example. Region 34 may be disposed within cylinder 28 and may be configured to hold a pressurized hydraulic fluid. Line 36, shown within the wall of tube 32, provides hydraulic fluid to aperture 38. The hydraulic fluid may be provided into region 34 through aperture 38.

The pressurized hydraulic fluid in region 34 exerts a pressure on the surface 40 of piston 30. As the pressure on surface 40 is increased, the piston 30 translates outwardly from cylinder 28 (i.e., longitudinally along the axis of the system 10). Piston 30 may include one or more extensions 42 (e.g., sleeves, pins, protrusions, etc.), partially defining region 44. Region 44 may house a resilient member such as spring 46, biasing piston 30 towards a position within cylinder 28. One or more seals 48 may be used between cylinder 28 and piston 30 to prevent hydraulic fluid loss into the wellbore.

In the position shown in FIGS. 1 and 2, the piston 30 may be translated along the wellbore towards the flapper 20. In such a situation, one or more of the extensions 42 may interact with a portion of the surface 26 of the flapper 20. As shown, at least a portion of the flapper 20 may be contained between the piston 30 and the housing 12, holding the flapper 20 in an opened position. To facilitate this retention, flapper 20 may comprise an extension, protrusion, or contact member 25 (see FIG. 2) extending toward the piston 30. In some embodiments, the contact member 25 may be slanted or otherwise configured to facilitate engaging the abutting portion of the one or more extensions 42 of the piston 30.

Figure 3:
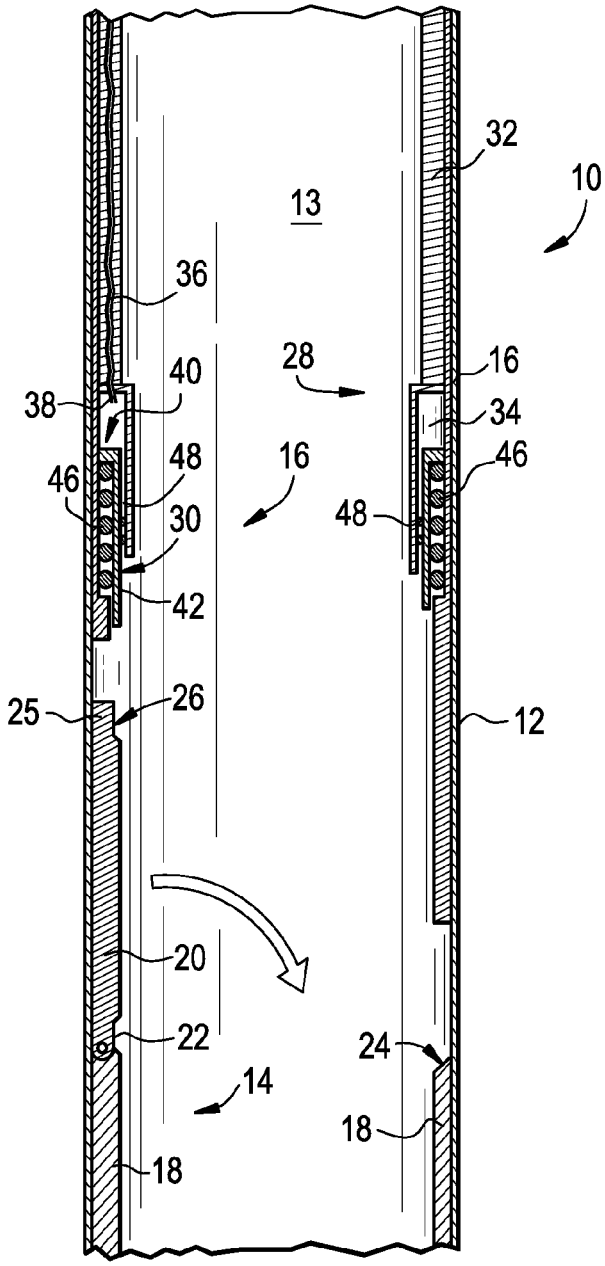
FIG. 3 is another cross-sectional view of a wellbore system in which both the retention system and the valve actuation system are retracted.

Referring to FIG. 3, the retention device 16 is shown in a position allowing valve 14 to close, but prior to closing. As previously described, when the fluid pressure on surface 40 is increased, piston 30 moves outwardly from cylinder 28. However, as shown in FIG. 3, when hydraulic pressure from the fluid is reduced relative to the pressure used in the configuration of FIGS. 1 and 2, spring 46 biases piston 30 to a position within cylinder 28. As a result, the one or more extensions 42 of piston 30 do not interact with contact member 25 of surface 26 of flapper 20 and piston 30 does not retain valve 14 in an open position. The flapper 20 may be free to move in the direction indicated by the arrow. In some embodiments, the flapper 20 may be biased in the closing direction via a spring or resilient member (not shown).

In some embodiments, the hydraulic line 38 used to pressurize region 34 may be in fluid communication with a primary valve actuation device such as a hydraulic piston used to open valve 14. For example, the hydraulic piston may translate sleeve 21 (see FIGS. 1 and 4) along the length of the valve 14, engaging the contact surface 26 and pivoting the flapper 20 to the open position shown in FIG. 1. The retention device 16 may be configured to either have a longer actuation length or an increased hydraulic resistance or both (for example) as compared to the hydraulic piston or primary valve actuation device used to open valve 14. This may allow the retention device 16 to activate after the flapper 20 has been fully opened by the primary valve actuation device. In addition, the retention device 16 may be configured to release after the flapper 20 is no longer held open by the primary actuation device.

Figure 4:
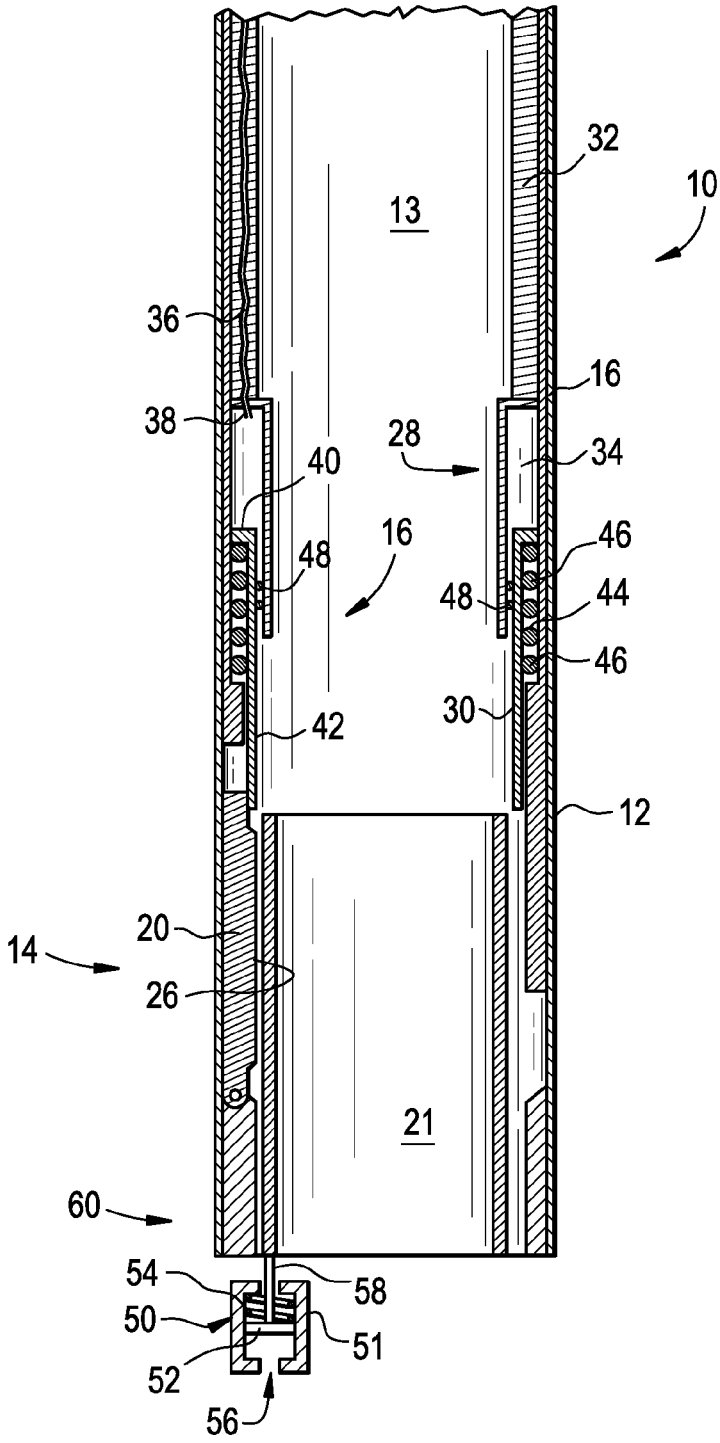
FIG. 4 is another cross-sectional view of a wellbore system in which the retention system and the valve actuation system are extended.

Turning now to FIG. 4, this figure illustrates a cross-sectional view of a wellbore system in which a primary valve actuation device 60 comprises a sleeve 21 and a valve hydraulic piston 50 for example. In other embodiments, the hydraulic piston 50 may be directly coupled to the flapper 20 or the flapper 20 may be actuated by a solenoid (not shown) or other electromechanical, mechanical, or pressure device.

As shown, the sleeve 21 is extended into the channel 13. In such a case, the outer circumference of the sleeve 21 may abut or contact the surface 26 of the flapper 20 of the valve 14. As the sleeve 21 translates relative to the valve 14, the interaction between the sleeve 21 and the flapper 20 may move the flapper 20 between a first position and a second position.

The sleeve 21 may translate due to the actuation of the valve hydraulic piston 50. Valve hydraulic piston 50 may comprise a housing 51 containing an actuating piston 52 and a resilient device 54. In some embodiments the resilient device 54 may be a coil spring or gas spring (among other types of resilient devices). The housing 51 may have an opening 56 hydraulically coupled to a hydraulic line (not shown) such as hydraulic line 36 for example. The actuating piston 52 may be indirectly or directly coupled to the sleeve 21, for example, through member 58. Applying pressure to the actuating piston 52 may translate the sleeve 21 into the valve 14, thereby opening the valve 14. Reducing the pressure may allow the resilient device 54 to translate the sleeve 21 out of the valve 14.

When opening, it is possible to either design the activation pressure of retention device 16 to be higher than that of the primary valve actuation device 60 used to open valve 14 or to design the time required for the retention device 16 to activate such that it is longer than that of the primary valve actuation device 60. For example, in some embodiments in order to lengthen the activation time of the retention device 16, it is possible to lengthen the distance of travel, increase the friction forces applied (e.g., by increasing the bore roughness to increase friction on the piston, or utilizing one or more seals having a high coefficient of friction), increase the damping forces applied or a combination of any of these or other known methods (e.g., by utilizing a higher spring force).

Since the retention device 16 must release after the primary valve actuation device 60 opening valve 14 has fully retreated, designing the activation pressure of the retention device 16 to be higher than the primary valve actuation device 60 would result in the retention device 16 activating prematurely. Thus, it may be preferred to increase the release time of the retention device 16 through lengthening the distance of travel, increasing the friction forces applied, increasing the damping forces applied or a combination of any of these or other known methods used to retard the activation of the retention device 16.

In other embodiments, an increase in the release time of the retention device 16 may be accomplished by adjusting the hydraulic area of the piston, passing the hydraulic fluid through a tortuous path, an orifice, or through a porous media or a combination of any of these or other known methods. In yet other embodiments, the retention device 16 may be operated on a hydraulic system subject to different pressure inputs than the primary valve actuation device 60.

Although the foregoing has been described with reference to exemplary embodiments, workers skilled in the art will recognize that changes may be made in form and detail without departing from the spirit and scope thereof. For example, although different example embodiments may have been described as including one or more features providing one or more benefits, it is contemplated that the described features may be interchanged with one another or alternatively be combined with one another in the described example embodiments or in other alternative embodiments. The present subject matter described with reference to the example embodiments and set forth in the following claims is manifestly intended to be as broad as possible. For example, unless specifically otherwise noted, the claims reciting a single particular element also encompass a plurality of such particular elements. Many other changes and modifications may be made to the present invention without departing from the spirit thereof. The scope of these and other changes will become apparent from the appended claims. In the case of described methods, unless otherwise stated, the steps of the methods described herein may be varied and carried out in different sequences.

What is claimed is:

1. A system for use in a wellbore, comprising:

a string having a housing comprising a valve in which the valve comprises a valve seat having an inner channel and at least one flapper configured to pivot relative to the valve seat;

wherein the at least one flapper is configured to move between a first open position and a second position in which the inner channel is obstructed;

a valve actuating device for selectively opening the valve, comprising a first hydraulic device and a first contact member to urge the flapper towards the first open position; and a retention device having a second contact member to retain the at least one flapper in the first open position after the first contact member has urged the flapper towards the first open position, the retention device comprising a second hydraulic device to move the second contact member into contact with the flapper.

2. The system of claim 1, wherein the first hydraulic device and the second hydraulic device are concurrently driven by the same fluid source.

3. The system of aim wherein the valve is a fluid loss control valve.

4. The system of claim 1, wherein the second hydraulic device comprises a cylinder and a piston.

5. The system of claim 1, wherein the inner channel of the valve seat is substantially unobstructed by the retention device.

6. The system of claim 1, wherein the second hydraulic device has an increased release time relative to the first hydraulic device, such that the second contact member does not release the flapper until after the first contact member allows the flapper to move towards the second position.

7. The system of claim 6, wherein the second hydraulic device has a distance of travel longer than that of the first hydraulic device.

8. The system of claim 6, wherein the second hydraulic device overcomes greater friction forces than the first hydraulic device.

9. The system of claim 6, wherein the second hydraulic device overcomes greater hydraulic resistance than the first hydraulic device.

10. A method for controlling wellbore fluids in which a well comprises a string having a housing containing a valve in which the valve comprises a valve seat having an inner channel and at least one flapper configured to pivot between a first position and a second position relative to the valve seat, the method comprising;

providing a valve actuating device for selectively opening the valve, comprising a first hydraulic device driven by a hydraulic pressure applied via a hydraulic control line;

providing a retention device configured to selectively retain the at least one flapper in the first position, the retention device comprising a second hydraulic device driven concurrently with the first hydraulic device by the hydraulic pressure applied via the hydraulic control line;

configuring the second hydraulic device to have an increased actuation time relative to the first hydraulic device upon application of the hydraulic pressure to the first and second hydraulic devices via the hydraulic control line.

11. The method of claim 10, wherein the second hydraulic device has a distance of travel longer than that of the first hydraulic device.

12. The method of claim 10, wherein the second hydraulic device overcomes greater friction forces than the first hydraulic device.

13. The method of claim 10, wherein the valve is a subsurface safety valve.

14. The method of claim 10, wherein the second hydraulic device overcomes greater hydraulic resistance than the first hydraulic device.

15. The method of claim 10, wherein the inner channel of the valve seat is substantially unobstructed by the retention device.

16. A valve for use in a wellbore comprising:

a valve seat, the valve seat having an inner channel;

a flapper configured to pivot relative to the valve seat between a first position and a second position in which the inner channel is obstructed; and a valve actuating device for selectively opening the valve, comprising a first hydraulic device to extend a first contact member into contact with the flapper to urge the flapper towards the first position; and a retention device configured to selectively retain the flapper in the first position, the retention device comprising a second hydraulic device, wherein the first hydraulic device and the second hydraulic device are driven by the same fluid source, and wherein, in response to a loss of hydraulic pressure, the valve actuating device retracts the first contact member to allow the valve to close prior to the retention device releasing the flapper.

17. The system of claim 16, wherein, upon the loss of the hydraulic pressure, the second hydraulic device has an increased release time relative to the first hydraulic device.

18. The system of claim 16, wherein the second hydraulic device has a distance of travel longer than that of the first hydraulic device.

19. The system of claim 16, wherein the second hydraulic device overcomes greater hydraulic resistance than the first hydraulic device.

* * * * *